United States Patent [19]

Bryant

[11] 3,977,139

[45] Aug. 31, 1976

[54] TOWER HAVING RAISING AND LOWERING MEANS

[76] Inventor: Raymond S. Bryant, Rte. 1, Elko Road, Unadilla, Ga. 31091

[22] Filed: May 23, 1975

[21] Appl. No.: 580,313

[52] U.S. Cl. ..... 52/116; 52/117; 52/121; 52/697

[51] Int. Cl.[2] ..... E04H 12/34; E04C 3/02

[58] Field of Search ..... 52/116, 146, 123, 117, 52/118, 119, 120, 121, 697; 343/874

[56] References Cited

UNITED STATES PATENTS

| | | | |
|---|---|---|---|
| 2,213,870 | 9/1940 | Scholl | 52/117 |
| 2,581,351 | 1/1952 | Black | 52/116 |
| 2,795,303 | 6/1957 | Muehlhause et al. | 52/121 |
| 2,822,066 | 2/1958 | Hanson | 52/117 |
| 3,110,368 | 11/1963 | Ross | 52/121 |
| 3,494,593 | 2/1970 | Blagg | 52/116 |

*Primary Examiner*—Ernest R. Purser
*Assistant Examiner*—Robert C. Farber
*Attorney, Agent, or Firm*—Patrick F. Henry

[57] ABSTRACT

A tower which is especially useful as a radio antenna tower comprises an elongated antenna pole or mast having reinforcing truss structures on opposite sides thereof comprising triangular trusses at spaced locations. One set of trusses on one side employ truss members extending perpendicularly from the mast whereas the other set of trusses on the other side comprises angular truss members joined at their extremities by a truss base. The mast is pivotally supported on a base which is a large pipe cemented into the ground. A cable and pulley system is operated by an electric motor to elevate the mast from its angular position on the ground to an upright position or vice versa to lower the mast to the ground.

9 Claims, 6 Drawing Figures

TOWER HAVING RAISING AND LOWERING MEANS

BACKGROUND OF THE INVENTION

1. Field of the Invention

The field of the invention would seem to include masts, poles, radio towers and the like. Vertical truss structures could be considered. The classification would appear to be in Group 350 and is identified as Class 343, Subclass 874 and Class 52, Subclasses 116 and 146.

2. Description of the Prior Art

The prior art radio antennas are usually large truss structures at the base made up of a plurality of trusses which are bolted or welded to a concrete footing and then assembled vertically by a construction crew using experienced men who assemble the section at great heights from the ground. It requires a considerable amount of expertise on the part of the construction project as well as the individuals and once such a tower is built it cannot be lowered to the ground except by disassembly in sections and if any work is to be performed on portions of the higher sections it is necessary to disassemble and remove same to the ground. If such standing towers must be completely removed from a section of property it is necessary to expend large sums to disassemble the tower and then to destroy the concrete base. Also, the conventional towers must be reinforced by struts or guidewires extended at an angle for a substantial distance from the base which requires a great deal of land area that is not always available in the metropolitan area. For this reason, it is sometimes necessary to acquire substantial space in a metropolitan area just for the purpose of erecting a radio or television tower and it it not possible to use the space around the tower for any other purpose such as parking automobiles because of the reinforcing guidewires and struts. The present tower is self-supporting to the extent that all of the reinforcing and truss structure is on the mast or pole itself and although guidewires or struts may be used as an additional precaution these are not required or necessary. Further, in the present device it is possible to assemble the device on the ground in place on the end of the base support member and then by the winch and cable structure which is mounted on the base support to raise the tower to its elevated position and lock same in place.

SUMMARY OF THE INVENTION

The present invention is a self-supporting mast or pole structure which is mounted on a permanent, but removable, base which extends upwardly from the ground and there is a raising and lowering means between the permanent base and the movable mast or pole structure.

An object of this invention is to provide a self-supporting radio tower which can be moved from a vertical position in use to a substantially horizontal position for maintenance and service and thence back to normal vertical position.

A further object of the present invention is to provide a mast or pole which is pivotally mounted on a base and having a raising and lowering mechanism in conjunction therewith.

Still another object of the present invention resides in the particular winch, drum and cable arrangement employing a pulley system which is capable of lifting a long tower structure by pulling on the free end thereof.

An additional object of the present invention is found in the ease by which it can be readily assembled and disassembled and whereby practically all of the work is done nearly at ground level without using experienced personnel having expertise in working at great heights.

An additional object of the present invention is found in the arrangement whereby the tower may be lowered to the ground and the base and tower completely removed through the use of an ordinary cutting torch and even to the extent of using an air hammer to destroy the concrete in the ground and to return the area to normal use. This is especially valuable and important in situations where only temporary easement and leases can be obtained on space for the purpose of erecting a radio tower which must be removed on short notice.

The foregoing objects and advantages have in mind the erection of a tower which is entirely assembled substantially at ground level and raised to excess of 200 feet in height from a base which projects only 15 or 20 feet above the ground.

Other and further objects and advantages of this invention will become apparent upon reading the following description of the preferred embodiment taken in conjunction with the accompanying drawings.

DESCRIPTION OF THE PREFERRED EMBODIMENT

Although it is mentioned herein that the present device is a radio tower it should be understood that there may be other uses for such a tower structure and therefore the device is not limited to radio or television use.

Figures 1, 2, 3:
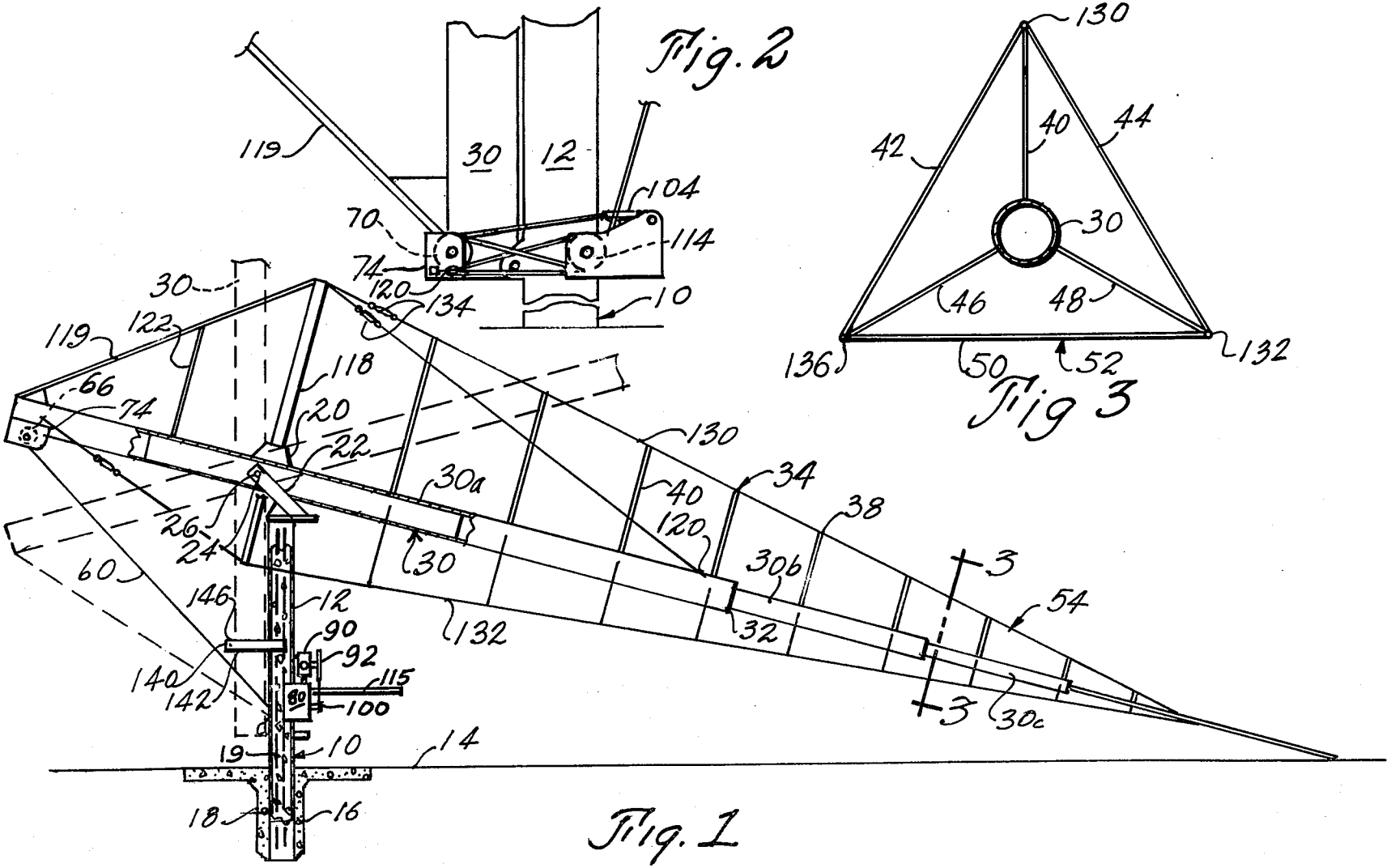
FIG. 1 is a side elevation view of the present tower shown in full lines in the ground position with dotted lines representing the stages of erection.
FIG. 2 is a side elevation view of the winch and pulley system on the base and free end of the mast.
FIG. 3 is a cross-sectional view taken along lines 3—3 in FIG. 1.
Figure 4:
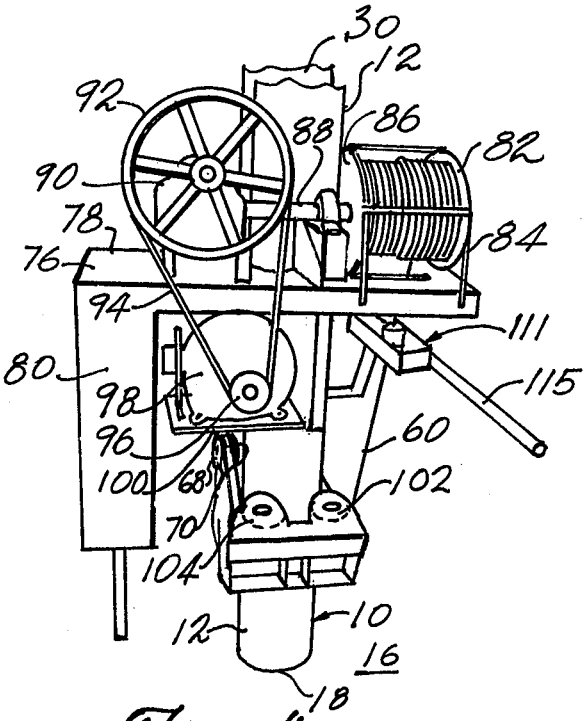
FIG. 4 is a perspective view of the winch and cable system on the base support.

The device shown in FIG. 1 comprises a rigid base structure designated generally by reference numeral 10 and having a large reinforced steel base pipe member 12 which is inserted in a hole in the ground 14 and concreted in place by concrete 16 to provide a vertical base member 12 extending approximately 20 feet above the ground. A suitable hole 18 is dug in the ground 14 and the bottom end of the pipe 12 is positioned in the hole 18 and the hole 18 as well as the inside of pipe 12 are reinforced as deemed necessary with concrete reinforcement rods and wire mesh 19 after which concrete 16 is poured in place. Attached to the upper end of the pipe 12 is a pair of heavy steel triangular reinforcing plates 20 each having a projecting support arm member 22 mounted thereon and having an opening 24 therein to receive a pivot pin 26 which is inserted through a hole in the lower portion of the long mast or antenna tower member 30.

The antenna mast or tower pole member 30 is a series of attached tubular pipes or pipe section members 30*a*, 30*b*, 30*c* becoming progressively smaller from the bottom to the top to reduce the weight and increase the flexibility of the mast member 30. The lower end of each section 30*b*, 30*c* above the section 30*a* is inserted in the open end of the respective end of the lower section and welded in place to provide an elongated and rigid structure of considerable strength at each joint 32 between the respective sections 30*a*, 30*b*, 30*c*. The mast or pole member 30 is also reinforced by respective support means on opposite sides thereof in the form of trusses 34 and 36 on the front and back side — the front being for purpose of reference that side of the mast 30 which is on the opposite side of the base 12 when the mast is in vertical position and the back being that side of the mast member 30 which is on the same side as the base 12. Truss 34 comprises a plurality of individual triangular truss sections 38 each consisting of a vertically projecting leg 40 mounted perpendicular to the mast member 30 and respective angular side truss members 42, 44 each radiating from the terminal end of the truss member 40 and being attached to a respective one of a pair of angularly disposed truss members 46, 48 having one end of each thereof welded or otherwise attached to the mast member 30 on the back side of the mast and the other respective terminal ends thereof connected by a connecting truss member 50 thereby creating with member 50 a truss 52 on the back side of the mast member 30 which is connected to the truss 34 on the front side by means of the respective truss member 42, 44. This provides a self-supporting mast or radio tower complete assembly including the mast member 30 and the trusses 34, 36 and designated generally by reference numeral 54 and which is a complete structural entity into itself normally nor requiring any guidewires or side supports or other structural members although guidewires or jack stays (not shown) may be added for extra precaution wherever required by local laws or as an additional safety factor whenever the land space is available. However, it should be understood that the present radio tower 54 is intended to be over 200 feet tall and completely self-supporting after it has been elevated to its vertical position.

To raise or lower the entire tower structure 54 a winch and cable system is mounted on the base with practically all of the winch and cable and motor drive mounted on the base 12 connected by a cable 60 which passes through pulleys 64, 66 and 68, 70 on opposite sides of the lower end of the mast 30 mounted on pulley support plates 74. A vertical base plate arrangement 76 consisting of a heavy metal horizontal plate 78, having an electrical control box thereon, is 80 welded to the lower portion of the base pole 12 and supports a cable winch 82 mounted on side plates 84, 86 and driven from a shaft 88 from a transmission 90 which is transmitting power from a large pulley wheel 92 driven by a belt 94 from an output pulley 96 on an electric motor 98 mounted on a base plate 100 welded to the lower end of base pole 12. The cable 60 system comprises in addition to pulleys 64, 66 et al. mentioned above, a set of multiple transfer pulleys on the base pole 12 and there being pulleys 102, 104 mounted on a pulley frame 106 welded to the lower end of the pole 12 and side pulleys 108, 110 having the cable 60 from a brake 111 passing around pulley 108 thence pulley 64, around pulleys 110 and 66 (see FIG. 6) to provide a mechanical advantage around the pulleys 102, 104 to a set of side transfer pulleys 114, 116 mounted on the side of the base pole 12 and thence to the pulleys 68, 70 and around pulley 114 on the opposite side of the lower end of the mast member 30 as seen in the diagram in FIG. 6. Cable 60 extends around the pulley 114 to a securing point or a fitting 120 attached to mast 30. A large reinforcing member 118 extends vertically outwardly from the lower front of the mast 30 and has a steel rod 119 attached thereto and to the end of mast 30. Rod 119 is braced by a rod 122. Galvanized aircraft winch cable of ⅜ inches in diameter is found to be suitable. Brake 111 has a cable control handle 115 which is operated manually to control cable 60.

The truss members 40 are connected longitudinally by means of truss cable 130 which may be steel cable ⅝ to ⅞ inches in diameter. Similar cable 132 is used to connect the ends 136 of the individual truss section 52. Cables 130, 132 are provided with turn buckles 134.

Figure 6:
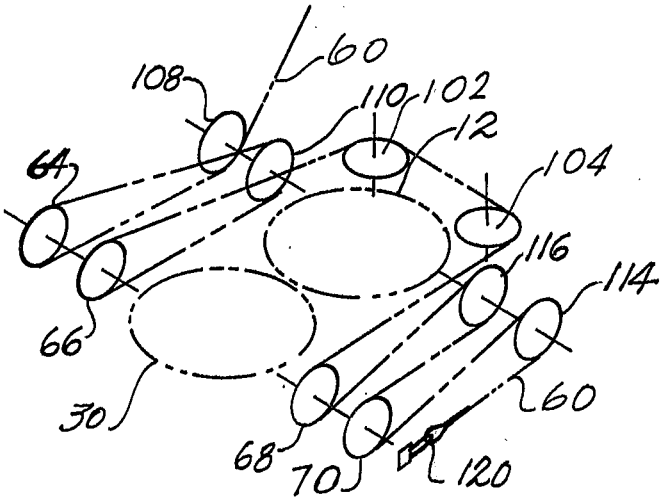
FIG. 6 is a diagrammatic view of the pulley system.
Figure 5:
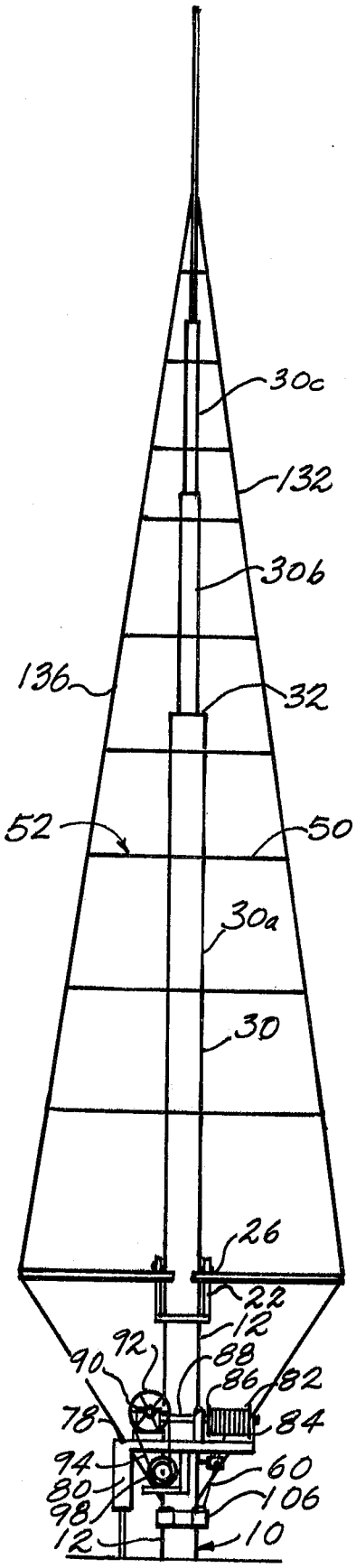
FIG. 5 is an elevation view of the device with the mast raised to vertical position.

When the complete tower is in vertical position the lower end of the tower is secured to the base by means of form fitting welded steel plates 140, 142 which are welded to the base pole 12 and extend around opposite sides of the lower end of the mast member 30 to receive a hasp 146 which is securely locked by a padlock (not shown). In FIG. 1 of the drawings the mast member 30 is shown of course attached to the upper end of the base pole 12 and extending at an angle with the tip resting on the ground. Initially, the entire mast structure including the mast member 30 and the structure 34, 36 are prefabricated which may be done on the site through the use of welding and cutting torch equipment or may be done in a shop and trucked to the site and assembled in place flat on the ground. A small crane or something in the order of a large truck wrecker or the like is used to lift the lower end of the mast member 30 upwardly high enough to put it into position so that the pin 26 may be inserted to securely attach the mast member 30 to base pole 12 at which time the cable 60 is attached securely in place and the mast 30 is ready to be raised through the use of the motor 98 which may be operated from an electrical cable extended to a suitable source of electrical current; or a portable generator on a truck may be moved to the site and hooked up to motor 98 temporarily for the purpose of raising the mast 30 or vice versa when it is desired to lower the tower. It is worthwhile to note that absolutely no climbing is required or necessary or desired and there can be no danger from falling tools, pieces of structure or from the experienced workmen slipping and falling from such heights. Also, the great expense and possible tragedy of having a section fall from a great height before it is securely welded in place, as can occur with the other type of towers, has been eliminated. The mast 30 is raised from the FIG. 1 position by operating the winch 82, controlled by handle 115, to wind cable 60 on the winch 82 thereby reeling in cable 60 over the pulleys as depicted in FIG. 6 to pull on opposite sides of the mast 30 on the respective pairs of pulleys 64, 66 and 68, 70 thereby gradually lifting the mast (as shown in dotted lines in FIG. 1) until it is in the straight position shown in FIG. 5.

While I have shown and described a particular embodiment of this invention together with suggested advantages and uses thereof this is by way of illustration only and does not constitute any sort of limitation on the scope of the invention as set forth in this specification since various alterations, changes, deviations, eliminations, amendments, revisions and departures may be made in the preferred embodiment as shown without departing from the scope of the invention as defined only by a proper interpretation of the appended claims.

What is claimed is:

1. In a tower structure: a tower base secured to the ground and having a portion extending upwardly therefrom; an elongated mast having an upper end and a lower end and being movably attached to said base near the lower end thereof for elevation thereon; means for attaching said mast to said base, a plurality of truss structures on said mast spaced from each other along the length thereof for preventing said mast from bending excessively when raised to elevated position so as to prevent collapse thereof; an elongated reinforcing member attached to said mast near the attachment thereof to said base, a brace member extending outwardly from said mast between and in line with the reinforcing member and the end of the mast, said brace member being shorter than said reinforcing member, each of said trusses comprising an elongated perpendicular member substantially in line with said reinforcing member and said elongated members being progressively shorter from the reinforcing member toward the end of the mast, a rod member attached to said reinforcing member and to the brace member and to the lower end of said mast, a flexible member attached to all of said perpendicular members and to the upper end of said truss structures also including other truss members attached and extending at an angle from said perpendicular truss members, winch and cable means operable between said base and said mast for pulling on said mast about said attachment between the mast and the base to cause said mast to elevate; and means for securing said mast to said base after being raised to elevated position.

2. In a tower structure: a tower base secured to the ground and having a portion extending upwardly therefrom; an elongated mast movably attached to said base near the lower end thereof to be elevated thereon to extend upwardly therefrom; truss structures on said mast along the length thereof for preventing said mast from bending excessively when raised to elevated position; a winch and cable system on said tower structure for raising and lowering same comprising a winch on said base, drive means for said winch, at least one cable transfer pulley on each side of said base, at least one pulley on each side of said mast, and at least one transfer pulley between the pulley on the side of the base, said cable extending and passing about said pulleys to be reeled on said winch thereby pulling said mast to extended position.

3. The device claimed in claim 2: said winch being mounted on said base, and there being double sets of pulleys on each side of said base and on said mast on opposite sides thereof whereby said cable is wound around said double pulleys on both sides of both said mast and said base to exert force on said mast to elevate same.

4. The device claimed in claim 1 wherein said truss member comprising triangular truss sections on one side consisting of said angular members connected at the free ends by a third truss member, and truss cable members joining all of said truss members on one side and all of said truss members on the other side.

5. The device claimed in claim 1 wherein said cable members on one side are attached to the ends of said perpendicular members and the cable members on the other side are attached to each corner of the triangular truss sections on that side.

6. The device in claim 1 wherein said one end of said cable is attached to said mast, at least one pulley on each side of said mast, and at least one pulley on each side of said base, and at least one transfer pulley between said pulleys on the sides of said base, said cable extending and passing about said pulleys to be reeled onto said winch thereby pulling said mast to elevated position.

7. The device in claim 6: said winch being mounted on said base, and there being double sets of pulleys on each side of said base and on said mast on opposite sides thereof whereby said cable is wound around said double pulleys on both sides of both said mast and said base to exert force on said mast to elevate same.

8. The device claimed in claim 2 wherein said truss members comprising triangular truss sections on one side consist of said angular members connected at the free ends by a third truss member, and truss cable members joining all of said truss members on one side and all of said truss members on the other side.

9. The device claimed in claim 2 wherein said truss cable members on one side are attached to the ends of said perpendicular members and the truss cable members on the other side are attached to each corner of the triangular truss sections on that side.

* * * * *